US009636726B2

(12) United States Patent
Nespoli et al.

(10) Patent No.: US 9,636,726 B2
(45) Date of Patent: May 2, 2017

(54) APPARATUS FOR CHANGING ROLLS OF A STRAIGHTENING MACHINE

(71) Applicant: PRIMETALS TECHNOLOGIES ITALY S.R.L., Marnate (VA) (IT)

(72) Inventors: Danilo Nespoli, Vanzaghello MI (IT); Emanuele Pace, Legnano-MI (IT)

(73) Assignee: Primetals Technologies Italy S.R.L., Marnate (VA) (IT)

( * ) Notice: Subject to any disclaimer, the term of this patent is extended or adjusted under 35 U.S.C. 154(b) by 50 days.

(21) Appl. No.: 14/773,454

(22) PCT Filed: Jan. 30, 2014

(86) PCT No.: PCT/EP2014/051825
§ 371 (c)(1),
(2) Date: Sep. 8, 2015

(87) PCT Pub. No.: WO2014/135314
PCT Pub. Date: Sep. 12, 2014

(65) Prior Publication Data

US 2016/0016214 A1 Jan. 21, 2016

(30) Foreign Application Priority Data

Mar. 8, 2013 (EP) ..... 13425038

(51) Int. Cl.

| | |
|---|---|
| ***B21B 31/10*** | (2006.01) |
| ***B21D 1/02*** | (2006.01) |
| ***B21D 37/04*** | (2006.01) |
| ***B21D 37/14*** | (2006.01) |

(52) U.S. Cl.
CPC ..... *B21B 31/10* (2013.01); *B21D 1/02* (2013.01); *B21D 37/04* (2013.01); *B21D 37/147* (2013.01)

(58) Field of Classification Search
CPC ..... B21B 31/10; B21D 1/02; B21D 37/04; B21D 37/147
See application file for complete search history.

(56) References Cited

U.S. PATENT DOCUMENTS 8,336,354 B2 12/2012 Haag et al.

FOREIGN PATENT DOCUMENTS

| | | | |
|---|---|---|---|
| DE | 2131739 | A1 | 5/1972 |
| DE | 202007015406 | U1 | 2/2008 |
| DE | 102007046138 | B3 | 6/2009 |
| WO | 2008145355 | A1 | 12/2008 |

*Primary Examiner* — Teresa M Ekiert
(74) *Attorney, Agent, or Firm* — Laurence A. Greenberg; Werner H. Stemer; Ralph E. Locher

(57) ABSTRACT

An apparatus changes rollers of a straightening machine. The straightening machine contains a plurality of cantilever roller shafts for receiving the rollers. The apparatus contains at least a trolley having a device for supporting an entire set of upper and/or lower rollers to be installed in or taken off from the straightening machine. The apparatus further has at least two vertical plates spaced apart horizontally, a device for releasably securing the plates to the trolley, and an actuator connected to the plates and intended to be received in first passages defined in the straightening machine. The actuator is able to reversibly displace the plates and the trolley between a first position wherein the plates and the trolley are close to the straightening machine and a second position wherein the plates and the trolley are spaced apart from the straightening machine.

15 Claims, 8 Drawing Sheets

APPARATUS FOR CHANGING ROLLS OF A STRAIGHTENING MACHINE

BACKGROUND OF THE INVENTION

Field of the Invention

The invention relates to an apparatus for changing the rolls of a long metal products straightening machine.

Long metal products are often rolled and shaped by hot rolling. Upon cooling, deformities in the section of the long product may arise. These deformities can be corrected by mean of a straightening machine also called leveller or straightener. A straightening machine comprises multiple upper and lower rolls arranged such that they overlap, establishing an undulating route for the long product, which is then subjected to bending effects in alternating directions. The rolls are in contact with specific portions of the rolled section and impart repeated bending load along the length of the long product.

Rolls' wearing as well as the need of changing the rolls to adapt them to different rolled product's profiles or sizes are the main reasons for the straightening machine's rolls change.

Typical change of rolls is realized using a beam. This beam has to be hanged to the body of the straightening machine at rolls level.

The beam is lifted and maintained in position by mean of a crane and then coupled to the straightening machine.

The main problems with this solution are:

- the crane is engaged in lifting the beam during all the time needed for rolls replacement and the crane cannot then be used for production,
- the load of the carrying beam and the load of the rolls are shared between the crane and the straightening machine. This is a dangerous situation for the operators around as is always a hanging load,
- The carrying beam needs to be centred using the crane. This is a complicated and time consuming operation.

Furthermore, the entire process of the rolls change in a conventional straightening machine requires about 45 to 50 minutes; this set up is usually needed about 50 times per month, depending on the size and shape of the product to be straightened and the frequency of the straightening process. Therefore, about 2250 to 2500 minutes per month may be consumed for rolls change/set-up with consequent loss of productivity of the plant.

BRIEF SUMMARY OF THE INVENTION

A major objective of the present invention is to provide an apparatus for changing a full set of upper and/or lower rolls of a straightening machine at once, minimizing the use of a crane, avoiding a load hanging in an area of a plant where operators are working, and also minimizing the time needed for changing the rolls.

A companion objective of the present invention is to provide the ability to easily align the apparatus with the straightening for extraction and insertion of the rolls.

Another objective of the invention is to provide the ability to extract or install a complete set of upper rolls or lower rolls in one step.

The present invention achieves these and other objectives and advantages by the features of an apparatus for changing rolls of a straightening machine, said straightening machine comprising a plurality of cantilever roll shafts receiving the rolls, the apparatus comprises:

- at least a first trolley comprising means for supporting an entire set of upper and/or lower rolls to be installed in or taken off from said straightening machine,
- at least two vertical plates spaced apart horizontally,
- means for releasably securing the plates to the trolley,
- actuating means connected to the plates and intended to be received in first passages defined in said straightening machine, said actuating means being able to reversibly displace said plates and said trolley between a first position wherein the plates and the trolley are close to the straightening machine and a second position wherein the plates and the trolley are spaced apart from the straightening machine.

According to other features taken alone or in combination:

- the apparatus may further comprises a plurality of horizontal guides, each horizontal guides being connected to a plate and being intended to be received in a second passage defined in the straightening machine for guiding said plates during their motion;
- the first trolley defines a plurality of roll shaft receiving passages, each roll shaft receiving passage being located and designed to receive an extremity of a roll shaft of the straightening machine when the trolley is in said close position relative to the straightening machine;
- each one of said roll shaft receiving passages is located and designed to receive an extremity of an upper roll shaft of the straightening machine when the said trolley is in said close position relative to the straightening machine;
- each one of said roll shaft receiving passages is located and designed to receive an extremity of a lower roll shaft of the straightening machine when said trolley is in said close position relative to the straightening machine;
- the trolley comprises a horizontal beam wherein the passages are defined;
- each passage of said beam receives a ring extending in said passage, each ring comprising a shoulder intended to cooperate with a radial extremity of each roll, to secure the roll to the beam;
- said means for releasably securing the plates to the trolley comprise:
  - lock passages defined in the trolley and in each plate
  - a plurality of locking pins, each locking pin being intended to be received in a locking passage of the trolley and in a corresponding locking passage of a plate to secure the plate to the trolley;
- each of said locking pins comprises at one of its extremity a locking hammer head;
- each of said locking pins comprises at one of its extremity a knob comprising a handle, said knob being able to rotated from a position wherein said locking pin is fixedly secure said trolley and said plates to a position wherein said trolley and said plate can be separated;
- said trolley further comprises eyebolts, said eyebolts being intended to cooperate with carrying means for the removal of the trolley;
  - said trolley comprises a plurality of wheels intended to cooperate with rails installed in a plant;
  - at least one of said wheels comprises self-centring means authorising the auto-positioning of the trolley vis-á-vis said roll shafts of the straightening machine;
  - said first trolley comprises means for supporting an entire set of upper rolls, the apparatus further comprises a second trolley with means for supporting an entire set of lower rolls. This means that the invention also concerns an assembly comprising an upper trolley, a lower trolley having similar features to that of the first trolley but having dimensions authorising it to support an entire set of lower rolls.

The invention also concerns an assembly comprising a straightening machine and an apparatus as above defined.

BRIEF DESCRIPTION OF THE SEVERAL VIEWS OF THE DRAWING

Other objectives, features and advantages of the present invention will be now described in greater details with reference to the drawings, wherein.

DESCRIPTION OF THE INVENTION

Figure 1:
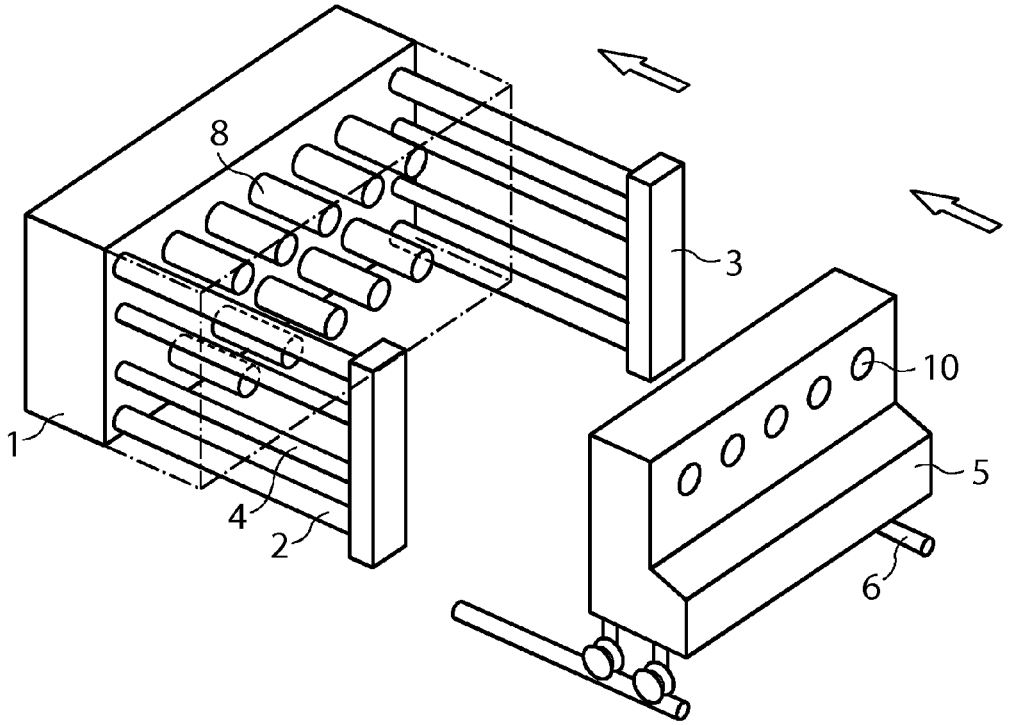
FIG. 1 is a schematic view of a long products straightening machine with a rolls changing apparatus according to the present invention.

In the figures, like reference numerals depict like elements.

FIG. 1 is a schematic view of a long products straightening machine 1 and of a rolls changing device or apparatus according to the invention. The straightening machine 1 comprises a plurality of rolls 8 arranged such that they overlap, establishing an undulating route for the long product, which is then subjected to bending effects in alternating directions. The rolls changing apparatus according to the invention comprises a trolley 5 defining a plurality of roll shaft passages 10 designed to receive an extremity of roll shafts bearing the rolls 8 to be changed. Rails 6 are provided for guiding motions of the trolley 5 toward or away from the straightening machine 1. The straightening machine 1 cooperates with side plates 3 which are intended to secure trolley 5 to the straightening machine 1. Each side plate 3 may be linked or connected to the straightening machine 1 by means of at least two horizontal guides 2 and by means of at least two hydraulic cylinders 4. Hydraulic cylinders 2 when actuated move each vertical side plate 3 which in turn displaces the trolley 5.

Figure 2:
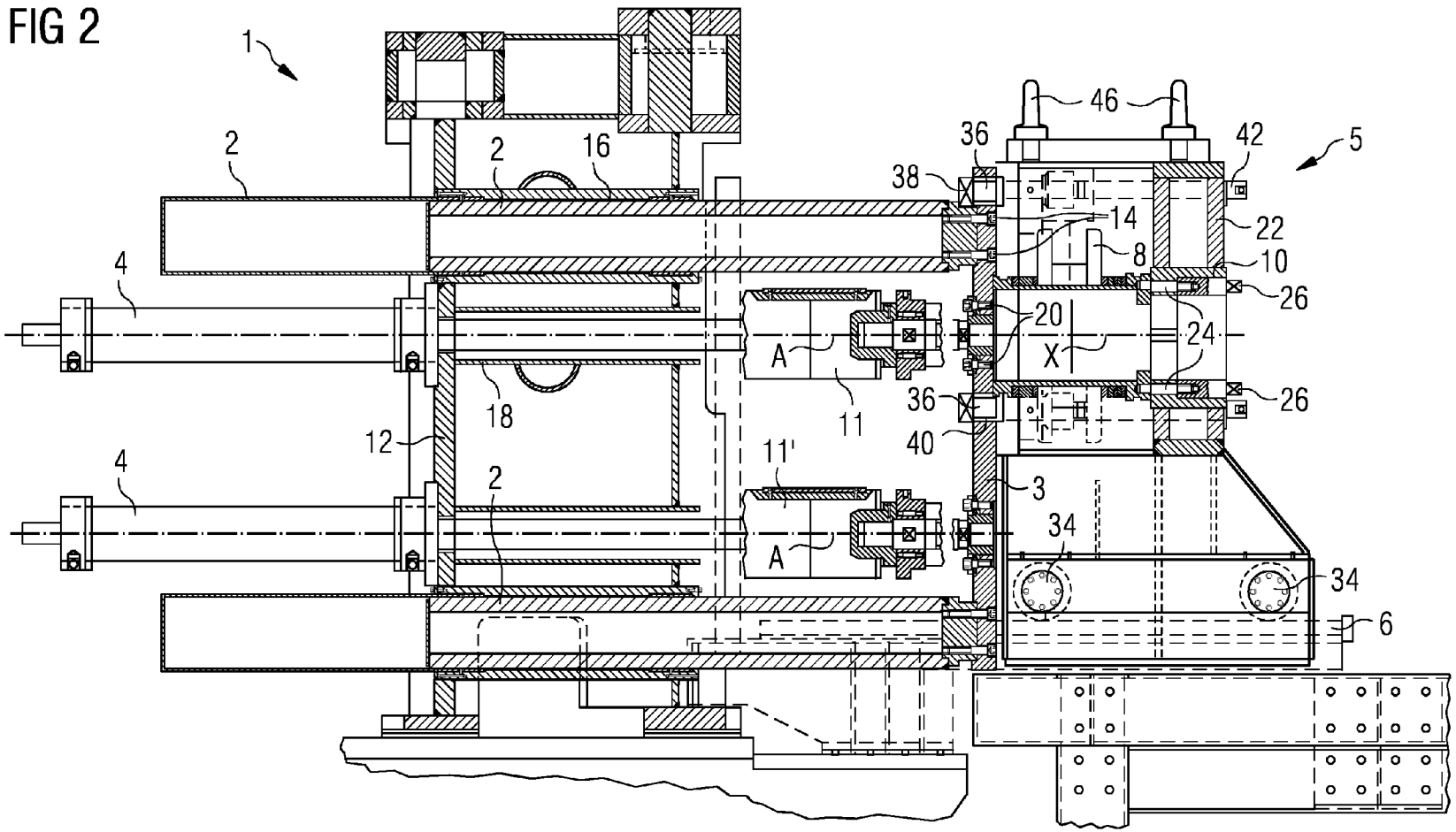
FIG. 2 is a transversal cross section of a straightening machine for long products with the apparatus for changing the upper rolls in a first position.

FIG. 2 is a transversal cross section of a long products straightening machine 1 with the device for changing its upper rolls 8 according the invention. The straightening machine 1 comprises a plurality of upper 11 and lower rolls shafts 11, 11' indented to receive rolls 8. Upper and lower roll shafts 11 and 11' extend horizontally in a cantilever fashion from the frame 12 of the straightening machine 1 and are journalled for rotation in this frame 12.

The frame 12 of the straightening machine 1 may define at least four guide passages 16 each receiving an above mentioned horizontal guide 2. To guide a horizontal translation of the vertical plate 3, each guide 2 is secured to one of the vertical plate 3. Each horizontal guide 2 is secured to its corresponding vertical plate by means of screws 14. In one embodiment, each plate 3 is secured to a pair of horizontal guides 2, each pair of horizontal guide being located in the same vertical plane.

Further, frame 12 of the straightening machine 1 defines at least four other passages 18 each receiving an above mentioned hydraulic cylinder 4. Each hydraulic cylinder 4 is secured at one of its extremity to a vertical plate 3 by means of at least two screws 20. Actuation of the hydraulic cylinders provokes the translation of the plates 3. In one embodiment, each plate 3 is secured to a pair of hydraulic cylinders 4, each pair of hydraulic cylinders being located in the same vertical plane.

The system according to the invention also comprises means to support simultaneously a plurality of worn or new rolls to be taken out from or installed in the straightening machine 1. In the embodiment of FIG. 2, the supporting means comprise a trolley 5. As can be best seen on FIG. 4, trolley 5 comprises a beam 22 extending in a horizontal plane between two foot 30 and 32. Beam 22 is fixedly secured to each feet 30, 32. Each feet 30, 32 extends in parallel vertical planes. A row of upper rolls 8 to be changed from or install in the straightening machine 1 are secured to beam 28.

Figure 7:
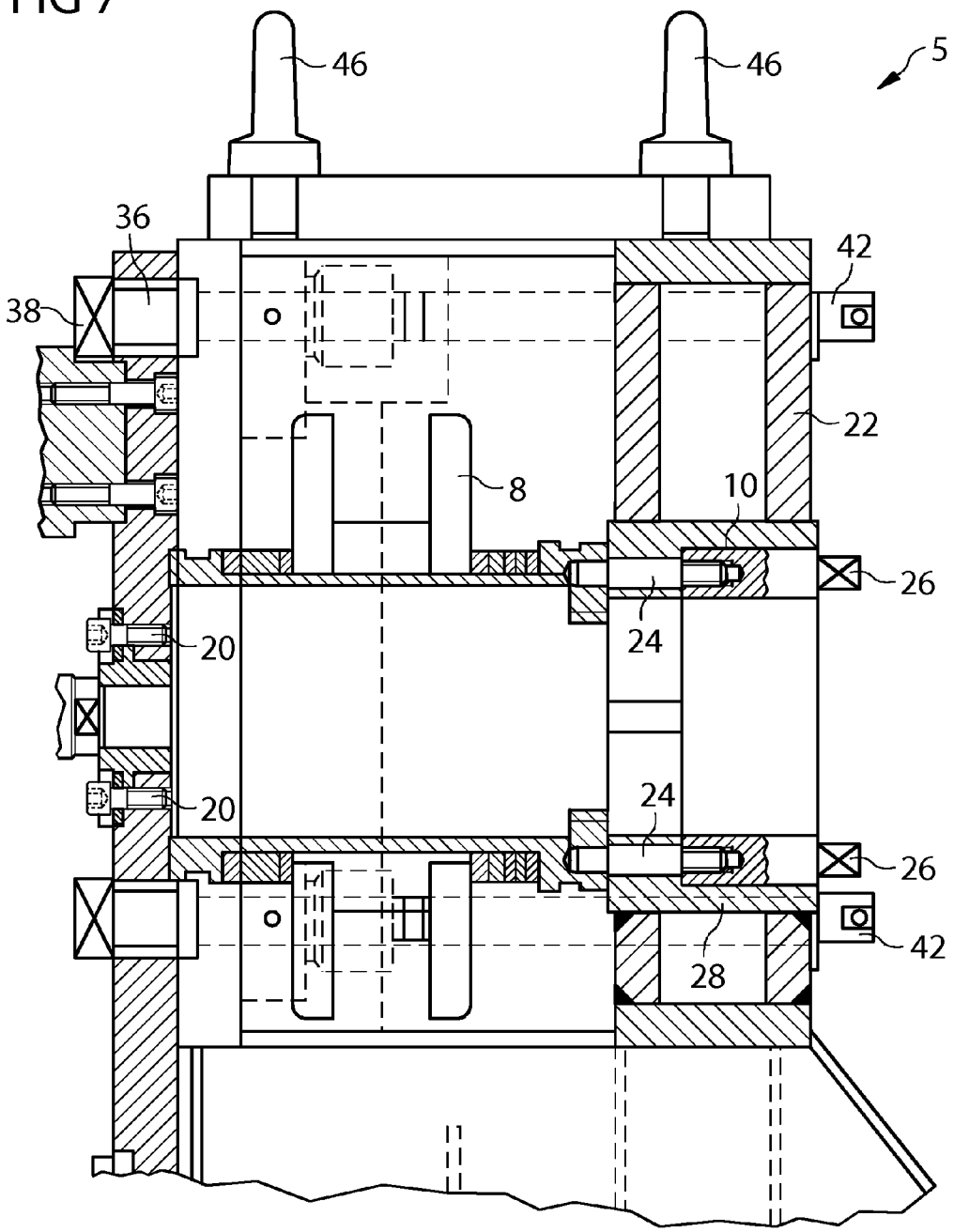
FIG. 7 is an enlargement of a portion of FIG. 2 showing the means used to secure the straightening rolls to the device according to the invention.

As can be best seen on FIG. 7, rolls 8 are secured to the beam 22 of trolley 5 by means of threaded pins 24 and bolts 26. More precisely, a radial extremity of each roll 8 is secured to a radial shoulder of a ring 28 received in frame 22 by means of said threaded pins 24 cooperating with said bolts 26.

The height of the feet 30, 32 and the thickness of the beam 22 is such that passages 10 are located in front of the upper rolls shaft 11 when the trolley 5 is in its closest position relative to the straightening machine 1. In one embodiment the passages 10 defined in the beam 22 are cylindrical and the height of the foot 30, 32 and the thickness of beam 22 are such that the axis A of each roll shaft 8 is aligned whit the axis X of a corresponding passage 10.

Trolley 5 also comprises supporting wheels 34 designed to cooperate with horizontal rails installed within the plant receiving the straightening machine 1. Each wheel 34 is located within feet 30 or feet 32. Wheels 34 support and guide trolley 5 on rails 36 when trolley 5 approaches or go away from the straightening machine 1. In one embodiment, at least one rail 6 has a prismatic shape and at least two wheels define also a complementary prismatic cross section to be able to cooperate with said rail.

Figure 8:
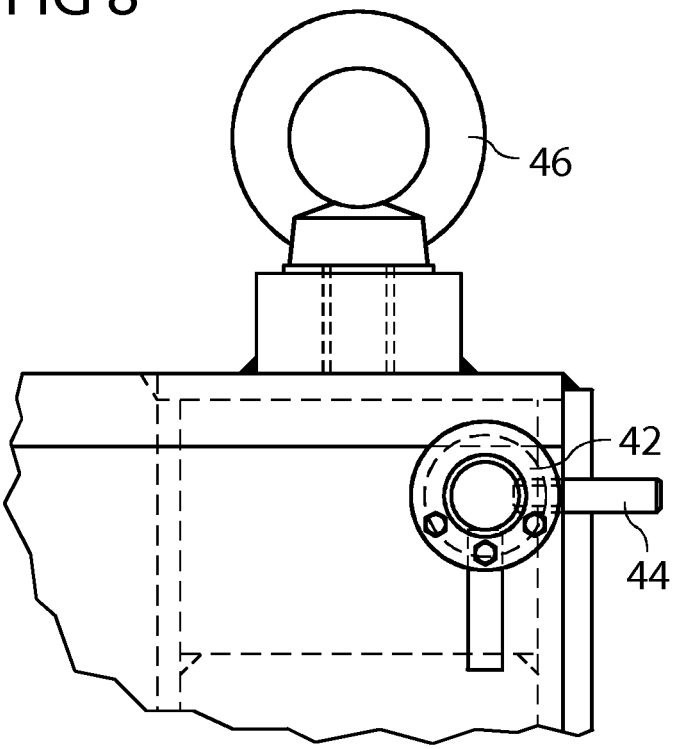
FIG. 8 is a detailed view of the means used to secure the invention to the straightening machine, and to a crane.

Furthermore, trolley 5 and plate 3 also comprise releasable means for securing them one to each other. In the embodiment of the figures and in particular in the embodiment of FIG. 2, trolley 5 and plate 3 also comprise each lock passages 40 which receive locking pins 36. Each locking pin 36 secures trolley 5 and plate 3. Each locking pin 36 may comprise at one of its extremity a locking hammer head 38. Each locking pin 36 may also comprise at its other extremity a knob 42. FIG. 8 is a front view of knob 42. As can be seen on FIG. 8, knob 42 comprises a handle 44. Knob 42 can be rotated from a position wherein locking pin 36 fixedly secure trolley 5 and plate 3 to a position wherein trolley 5 and plate 3 can be separated. Knob rotation angle can be for example 90°.

The trolley 5 comprises eyebolts 46 located on its top. Eyebolts 46 are used when the trolley 5 needs to be removed using a crane as this is explained under.

Figure 5:
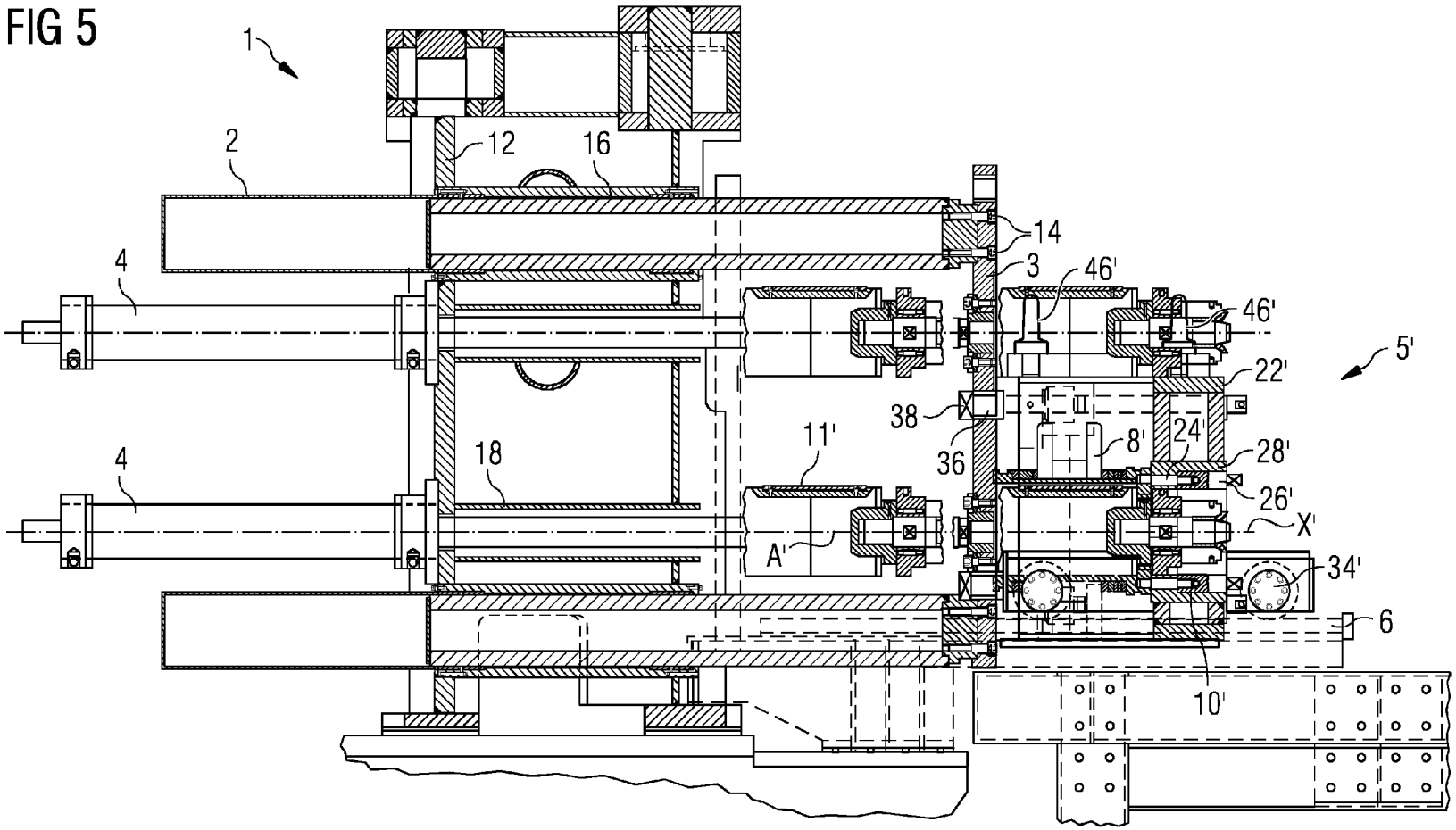
FIG. 5 is a transversal cross section of a straightening machine for long products with a device for changing the lower rolls in a first position.

FIG. 5 is a transversal cross section of a long products straightening machine 1 with a system for changing its lower rolls 8 according the invention. In FIG. 5 the straightening machine is the same that the one shown in FIG. 2. The means to move the lower trolley 5', namely hydraulic cylinders 4, guides 2 and plate 3 are also the same. In this embodiment, the trolley 5' designed to support lower rolls 8' also comprises a beam 22' extending in a horizontal plane. A row of lower rolls 8' to be changed from or install in the straightening machine 1 are secured to beam 22.

In a manner similar to what is shown on FIG. 7, lower rolls 8' are secured to the beam 22, of lower trolley 5', by means of screwed pins 24' and bolts 26'. More precisely, a radial extremity of each roll 8' is secured to a radial shoulder of a ring 28' received in and secured to said frame 22' by means of said threaded pins 24 cooperating with said bolts 26.

Figure 6:
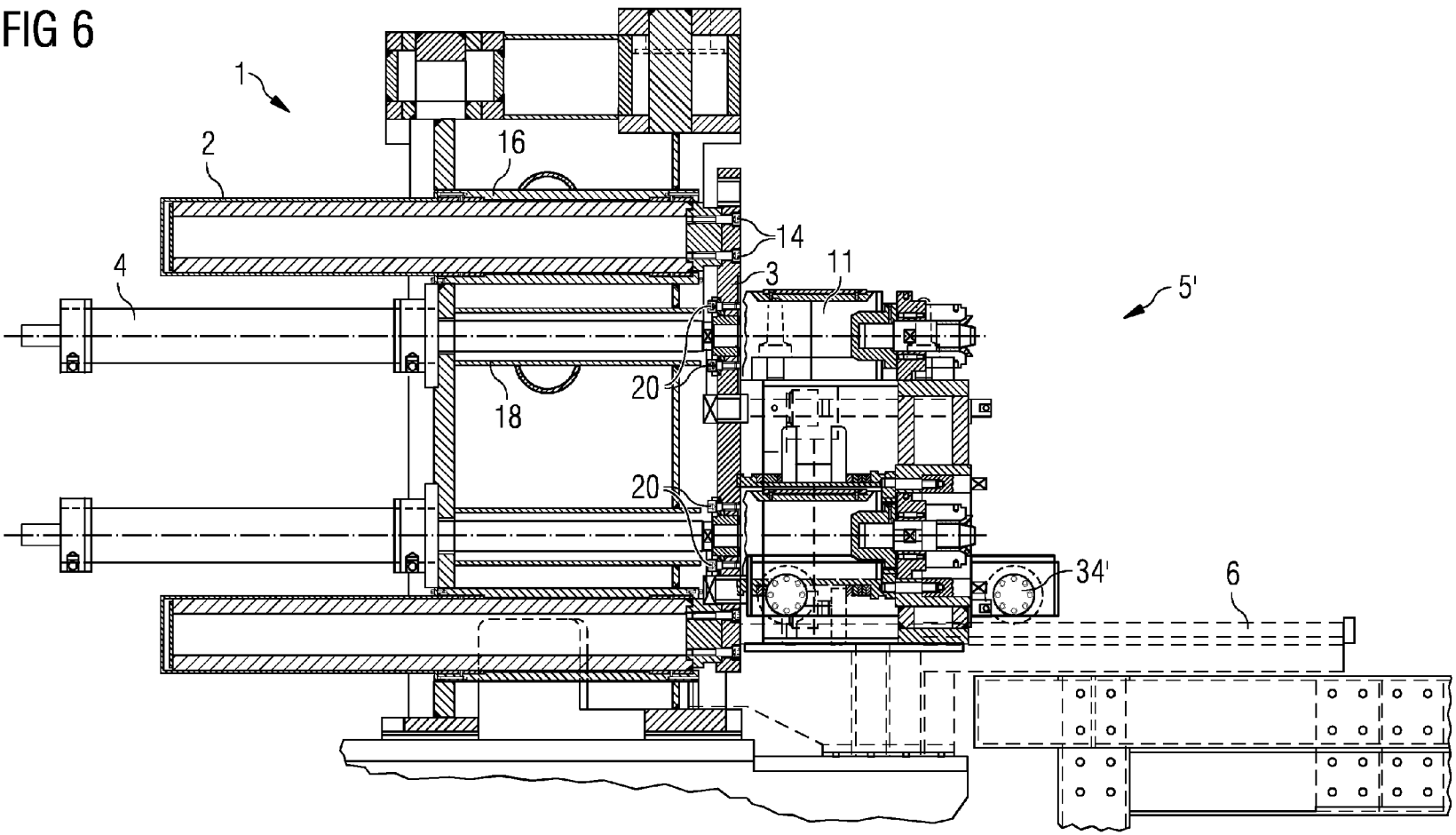
FIG. 6 is a view similar to FIG. 5 with the device for changing the lower rolls in a second position.

The thickness of the beam 22' is such that passages 10' defined by beam 22' are located in front of the rolls shaft 11' when the trolley 5' is in its closest position relative to the straightening machine 1. In one embodiment the passages 10' defined in the beam 22' are cylindrical and the thickness of the beam is such that the axis A' of each roll shaft 11' is aligned whit the axis X' of a corresponding passage 10'. Furthermore, and as can be seen in FIG. 6, the height of lower trolley 5' is such that said lower trolley 5' can pass under upper rolls shafts 11.

The trolley 5' also comprises wheels 34' designed to cooperate with horizontal rails installed within the plant receiving the straightening machine 1. Wheels 34' support and guide trolley 5' on rails 36 when said trolley 5' approaches or go away from the straightening machine 1.

Furthermore, trolley 5' and plate 3 comprise releasable means for securing them one to each other. More precisely, trolley 5' and plate 3 comprise each lock passages which receive locking pins 36. Each locking pin 36 secures trolley 5' and plates 3. Each locking pin 36 may comprise at one of its extremity a locking head 38 having a greater diameter than the diameter of the corresponding lock passage of plate 3. Each locking pin 36 may also comprise at its other extremity a knob 42 as above described.

The trolley 5' also comprises eyebolts 46 located on its top. Eyebolts 46' are used when the lower trolley 5' needs to be removed using a crane as this is explained under.

As can be seen on the figures, plate 3 extends in both directions beyond the axis of the upper and lower rolls. Furthermore, plate 3 can be used with upper or with lower trolley 5 or 5'.

When new rolls 8 need to be installed in the straightening machine, hydraulic cylinders 4 are actuated and this provokes translation of plates 3 from a position where plates 3 are closed to the straightening machine 1 to a position where plates 3 are spaced apart from the straightening machine, the translation of said plates 3 being guided by guides 2 (step 1). Locking pins 36 are thereafter introduced in the locking passages defined in each plate 3 and in each trolley 5 or 5' (step 2). Each knob 42 is subsequently rotated and each plate 3 is therefore secured to the upper or lower trolley 5 or 5' (step 3). This is the first state shown in FIGS. 2 and 5.

Before the above mentioned first state, an entire set of upper or lower rolls 8 or 8' has been secured to the upper or lower trolley 5 or 5' using the above described screw pins 24 or 24' and bolts 26, or 26' and worn rolls have been taken off from the straightening machine 1. Upper or lower trolley 5, 5' has also been installed on rails 6 by means of a crane (not shown on the figures) using eyebolts 46.

Figure 3:
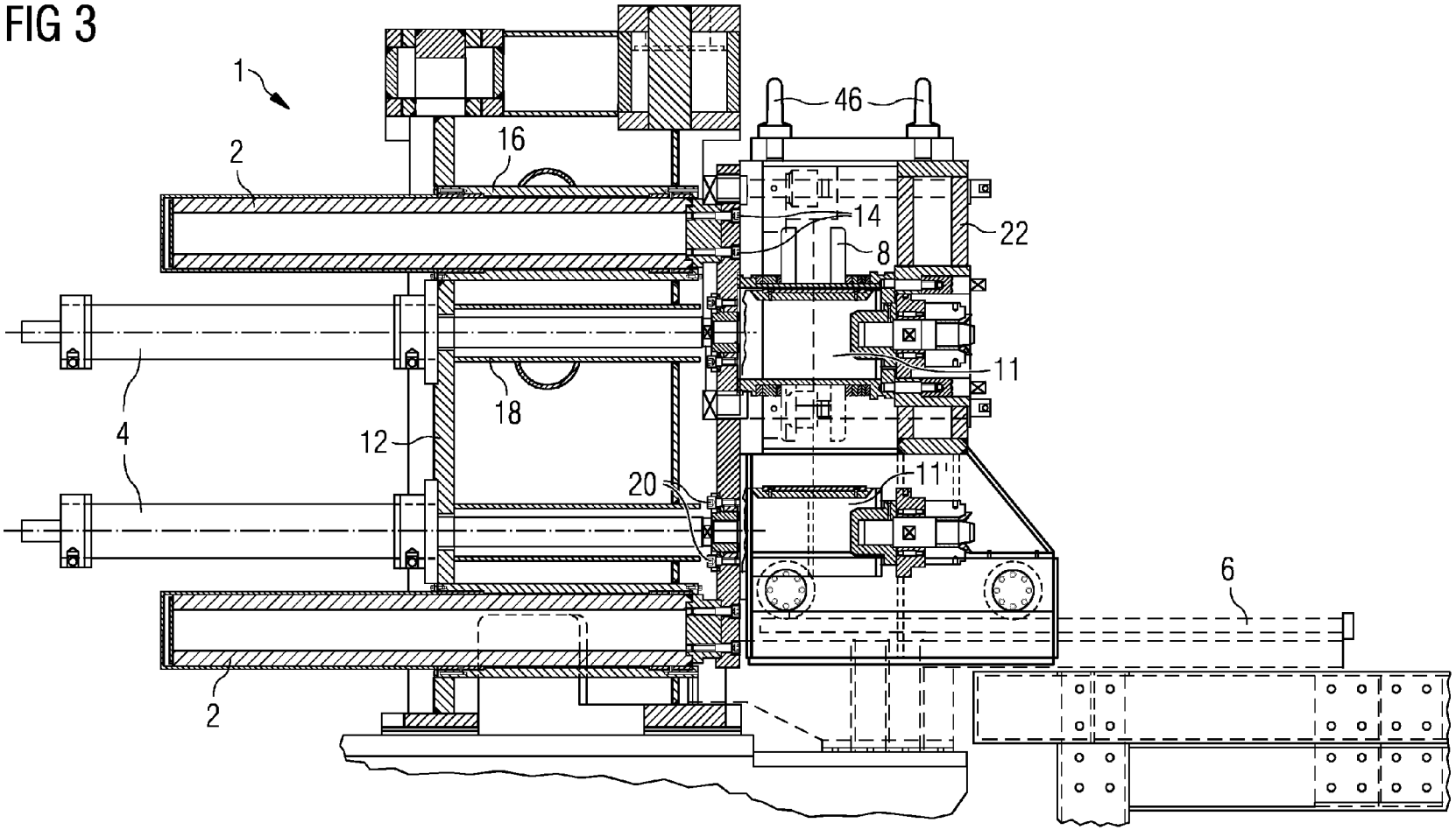
FIG. 3 is a view similar to FIG. 2 with the apparatus for changing the upper rolls in a second position.

Hydraulic cylinders 4 are actuated once more (step 4) and this provokes translation of plates 3 from a position where plates 3 are spaced apart from the straightening machine 1 (state shown in FIGS. 2, 4, and 5) to a position where plates 3 are close to the straightening machine (state shown in FIGS. 3 and 6), the translation of said plates 3 being guided by guides 2 and by wheels 34 or 34'. During this back translation or pulling phase, each upper or lower roll 8 or 8' is received on its corresponding upper or lower roll shaft 11 or 11'. During this phase, the free extremity of each upper or lower roll shaft 11 or 11' is received in a corresponding passage 10 or 10' defined in the upper or lower trolley 5 or 5'. This means that an entire set of upper or lower rolls is received at once in the straightening machine, or more precisely on the roll shafts 11 or 11'. The end of this back translation is shown in FIGS. 3 and 6. Subsequently, each roll 8 or 8' is released from it corresponding trolley and is secured to its corresponding roll shaft 11 or 11'.

After step 4, hydraulic cylinders 4 are actuated and push upper or lower trolley 8 away from the straightening machine 1 (step 5). The straightening machine is therefore ready for operation.

Figure 4:
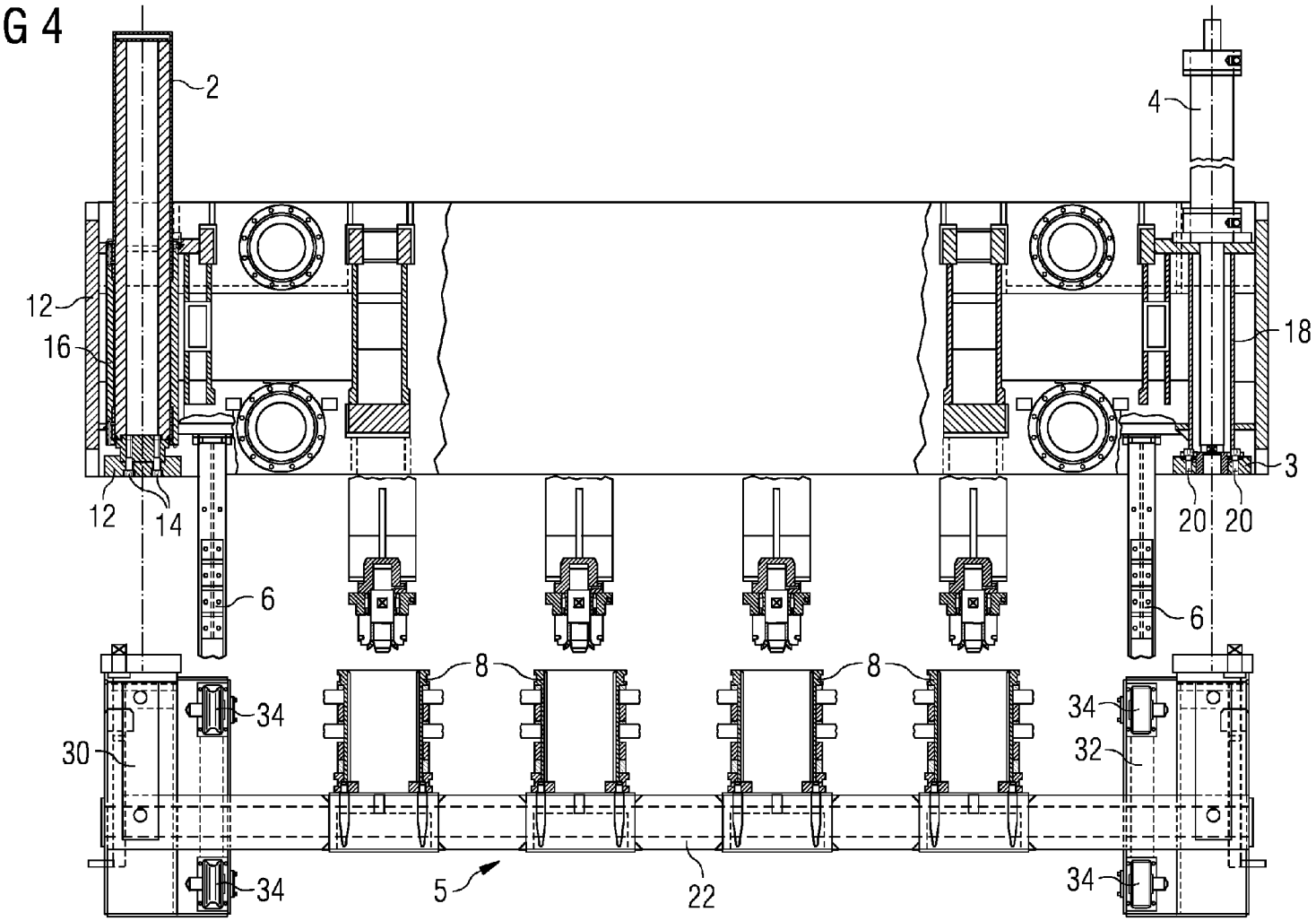
FIG. 4 is a top view of the apparatus shown in FIG. 2.

When worn rolls 8 have to be taken off from straightening machine 1 the above mentioned steps are realized in reverse. This means that FIGS. 3 and 6 can also represent a situation where upper or lower worn rolls 8 or 8' are present in the straightening machine 1. In this case, an entire set of upper or lower worn rolls 8 or 8' are released from the straightening machine and are secured to upper or lower trolley 5 or 5' thanks to screw pins 24 or 24' and bolts 26, or 26' (step 1'). Subsequently, hydraulic cylinders 4 are actuated and upper or lower trolley 5 or 5' are pushed away from the straightening machine (step 2'). This situation is shown in FIGS. 2, 4 and 5. Subsequently upper or lower trolley 5, 5' is secured to a crane (not shown on the figures) using eyebolts 46 or 46' (step 3'). Upper or lower trolley 5, 5' is removed from the rails 6 and lifted by the crane (step 4'). Upper or lower trolley 5, 5' loaded with upper or lower worn rolls 8 is taken to the workshop where the worn rolls are released from the trolley (step 5') and repaired. A second upper or lower trolley previously loaded with new rolls in the workshop can then be lead to the straightening machine using the crane. With this procedure, the time necessary to change rolls 8 and 8' is minimized.

In another embodiment, a trolley that combines extraction of upper and lower set of rolls is provided. In this embodiment not shown, the trolley can receive simultaneously a set of upper rolls and a set of lower rolls and is for example a combination of upper and lower trolley 5 and 5'.

As above shown, thanks to the invention, a full set of upper rolls (or lower rolls) can be extracted/installed at once (simultaneously) and then replaced minimizing the utilization of the crane, and minimizing the changing time (only 20 mn are now required). This means that if the straightening machine comprises five upper rolls, all the upper roll can be extracted/installed at once.

Furthermore, use of hydraulic cylinders to push out the trolley together with the rolls solves the problem of the extraction of rolls sized (mounted without clearance) on the supports.

Additionally, rolls are supported by upper or lower trolley once extracted there is therefore no dangerous hanging loads during rolls extraction and replacement.

Upper or lower trolley lies on prismatic rails and are therefore automatically aligned with the straightening machine once discharged by the crane, without need of any supplemental operation.

The invention claimed is:

1. An apparatus for changing rollers of a straightening machine, the straightening machine having plurality of cantilever roller shafts receiving the rollers, the apparatus comprising:

a trolley having a device for supporting an entire set of rollers including upper and/or lower rollers to be installed in or taken off from the straightening machine;

at least two vertical plates spaced apart horizontally;

fasteners for releasably securing said vertical plates to said trolley; and an actuator connected to said vertical plates and intended to be received in first passages defined in the straightening machine, said actuator being able to reversibly displace said vertical plates and said trolley between a first position wherein said vertical plates and said trolley are close to the straightening machine and a second position wherein said vertical plates and said trolley are spaced apart from the straightening machine.

2. The apparatus according to claim 1, further comprising a plurality of horizontal guides, each of said horizontal guides being connected to one of said vertical plates and being intended to be received in a second passage defined in the straightening machine for guiding said vertical plates during a motion of said vertical plates.

3. The apparatus according to claim 1, wherein said trolley has a plurality of roller shaft receiving passages formed therein, each of said roller shaft receiving passages being disposed and configured to receive an extremity of one of the cantilever roller shafts of the straightening machine when said trolley is in the first position relative to the straightening machine.

4. The apparatus according to claim 3, wherein each one of said roller shaft receiving passages is disposed and configured to receive an extremity of one of the cantilever roller shafts being an upper roller shaft of the straightening machine when said trolley is in the first position relative to the straightening machine.

5. The apparatus according to claim 3, wherein each one of said roller shaft receiving passages is disposed and configured to receive an extremity of one of the cantilever roller shafts being a lower roll shaft of the straightening machine when said trolley is in the first position relative to the straightening machine.

6. The apparatus according to claim 3, wherein said trolley contains a horizontal beam in which said roller shaft receiving passages are formed.

7. The apparatus according to claim 6, wherein each of said roller shaft receiving passages of said beam has a ring extending in said roller shaft receiving passage, each said ring containing a shoulder intended to cooperate with a radial extremity of each of a roller, to secure the roller to said beam.

8. The apparatus according to claim 1 wherein:

said trolley and said vertical plates having a plurality of lock passages formed therein; and said device for releasably securing said vertical plates to said trolley having a plurality of locking pins, each of said locking pins received in one of said lock passages of said trolley and in a corresponding one of said lock passages of one of said vertical plates to secure said vertical plates to said trolley.

9. The apparatus according to claim 8, wherein each of said locking pins has an extremity with a locking hammer head.

10. The apparatus according to claim 8, wherein each of said locking pins contains an extremity having a knob with a handle, said knob being able to rotated from a position wherein said locking pin is fixedly secure said trolley and said vertical plates to a position wherein said trolley and said vertical plate can be separated.

11. The apparatus according to claim 1, wherein said trolley further contains eyebolts, said eyebolts being intended to cooperate with carrying means for a removal of said trolley.

12. The apparatus according to claim 1, wherein said trolley has a plurality of wheels intended to cooperate with rails installed in a plant.

13. The apparatus according to the claim 12, wherein at least one of said wheels has self-centering means authorizing an auto-positioning of said trolley vis-a-vis cantilever roller shafts of the straightening machine.

14. The apparatus according to claim 1, wherein said trolley has said device for supporting the entire set of upper rollers;

further comprising a second trolley with a second device for supporting an entire set of lower rollers.

15. An assembly, comprising:

a straightening machine having rollers and cantilever roller shaft receiving said rollers, said straightening machine having first passages formed therein; and an apparatus for changing said rollers of said straightening machine, said apparatus containing:

a trolley having a device for supporting an entire set of said rollers including upper and/or lower rollers to be installed in or taken off from said straightening machine;

at least two vertical plates spaced apart horizontally;

fasteners for releasably securing said vertical plates to said trolley; and an actuator connected to said vertical plates and intended to be received in said first passages of said straightening machine, said actuator being able to reversibly displace said vertical plates and said trolley between a first position wherein said vertical plates and said trolley are close to said straightening machine and a second position wherein said vertical plates and said trolley are spaced apart from said straightening machine.

* * * * *